US005918312A

United States Patent [19]

Craren

[11] Patent Number: 5,918,312

[45] Date of Patent: Jul. 6, 1999

[54] GARMENT WITH DETACHABLE DROP CLOTH

[76] Inventor: Kyle C. Craren, 2632 S. 11th St., #R, St. Louis, Mo. 63118

[21] Appl. No.: 08/921,315

[22] Filed: Aug. 29, 1997

[51] Int. Cl.[6] ..... A41B 1/00

[52] U.S. Cl. ..... 2/69; 2/102; 2/108; 2/51

[58] Field of Search ..... 2/69, 69.5, 83, 2/85, 84, 93, 94, 95, 102, 115, 106, 108, 46, 51, 86, 243.1

[56] References Cited

U.S. PATENT DOCUMENTS

D. 257,910 1/1981 Viio .
D. 261,447 10/1981 Viio .
2,066,072 12/1936 Powell ..... 2/102
3,085,250 4/1963 Finlay ..... 2/102
4,369,526 1/1983 Clutts .
4,575,876 3/1986 Weaver ..... 2/69.5
4,669,127 6/1987 Swanson ..... 2/46
5,487,190 1/1996 Thompson .
5,566,391 10/1996 Williamson ..... 2/51

*Primary Examiner*—Gloria M. Hale
*Attorney, Agent, or Firm*—Patent & Trademark Ser.; Joseph H. McGlynn

[57] ABSTRACT

A vest/jacket for painters. It includes detachable sleeves, pockets and loops to hold various types of tools and supplies used by painters. It also includes a detachable drop cloth attached to the inside of the vest/jacket.

7 Claims, 2 Drawing Sheets

GARMENT WITH DETACHABLE DROP CLOTH

BACKGROUND OF THE INVENTION

This invention relates, in general, to vest/jackets, and, in particular, to a vest/jacket which can be worn by a painter and which has a built in drop cloth.

DESCRIPTION OF THE PRIOR ART

In the prior art various types of vests for workmen have been proposed. For example. U.S. Pat. Nos. Des. 257, 910and Des. 261,447 disclose vests which have pockets which can be folded into a use or non-use position.

U.S. Pat. No. 4,369,526 discloses a utility vest having plurality of detachable pouches for carrying various types of tools or supplies.

U.S. Pat. No. 5,487,190 discloses a vest having a series of horizontally disposed open ended sleeves for carrying caulking containers.

While various types of vest for workmen have been proposed, none have been designed to be used specifically by painters. The present invention is designed with a painter's needs in mind, and includes not only means for carrying various types of tools, but also a detachable drop cloth.

SUMMARY OF THE INVENTION

The present invention comprises a vest/jacket for painters. It includes detachable sleeves, pockets and loops to hold various types of tools and supplies used by painters. It also includes a detachable drop cloth attached to the inside of the vest/jacket.

It is an object of the present invention to provide a new workmen's vest/jacket for painters.

It is an object of the present invention to provide a new workmen's vest/jacket for painters which includes a detachable drop cloth.

These and other objects and advantages of the present invention will be fully apparent from the following description, when taken in connection with the annexed drawings.

DESCRIPTION OF THE PREFERRED EMBODIMENT

Figure 1:
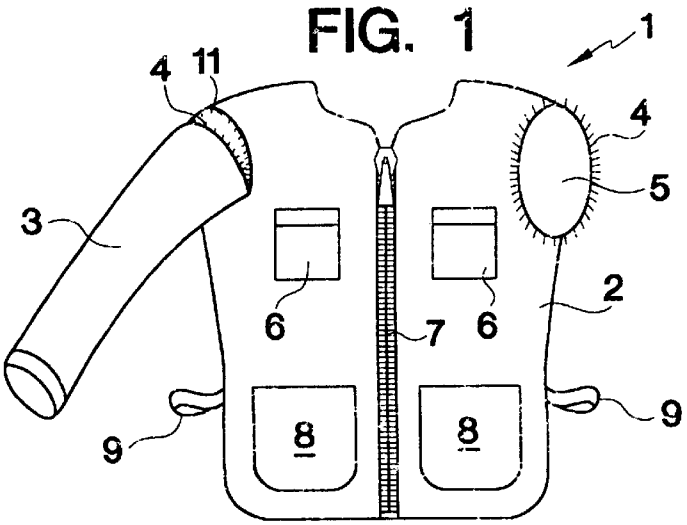
FIG. 1 is a view of the vest/jacket of the present invention showing one of the detachable sleeves.

Referring now to the drawings in greater detail, FIG. 1 shows the present invention 1 designed to be used by painters and which comprises a vest/jacket 2 which has detachable sleeves 3 (only one of which is shown in FIG. 1). The sleeves 3 can be attached to the arm holes 5 in the body of the vest/jacket by zippers 4, however, it should be understood that any type of fastener such as, but not limited to, Velcro could also be used to attach the sleeves to the vest/jacket.

The vest/jacket also has a zipper 7 to secure the vest/jacket on a person. Again, any conventional fastener could be used instead of the zipper without departing from the scope of the invention. Attached to the vest/jacket 2 is a plurality of pockets or pouches 6, 8 which could be used to hold various tools that a painter might use. The number and position of the pockets or pouches 6, 8 could be varied without departing from the scope of the invention. Attached to the sides of the vest/jacket 2 are loops 9 which will hold tools such as a paint brush or spackle knife. Again, the number and position of the loops 9 could be varied.

Preferably, the vest/jacket would be made from 100% cotton, however, other material could be used. In addition the vest/jacket would come in different sizes, such as small, medium and large, to fit everyone.

Figure 2:
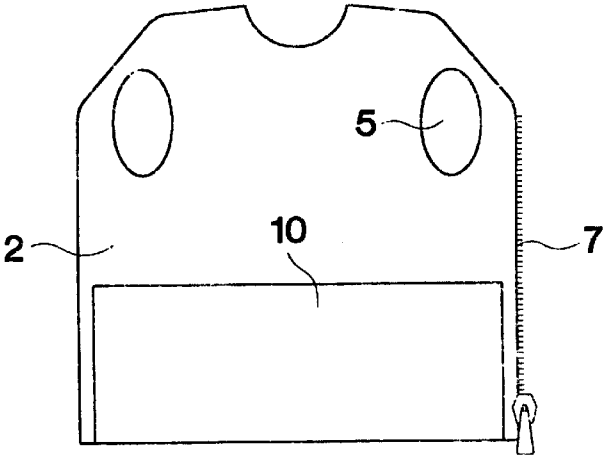
FIG. 2 is a a view of the inside of the vest/jacket of the present invention showing the position of the detachable drop cloth.

FIG. 2 shows the inside of the vest/jacket 2 with a drop cloth 10 in a folded condition. Normally, the drop cloth could be stored in this position until it is needed by the user. In the stored position the drop cloth would be out of the way, and would not interfere with a painter's normal activities while he/she is wearing the vest/jacket. The drop cloth could be made from a canvas-like material and sprayed with a polyurethane to prevent paint or other liquids from soaking through the drop cloth. The drop cloth could be made from other materials without departing from the scope of the invention.

Figure 3:
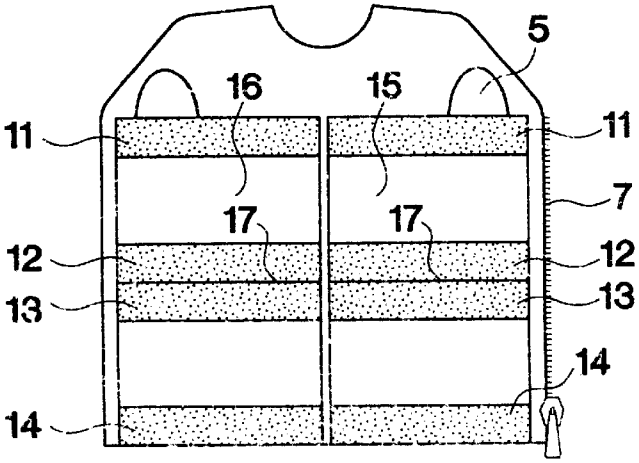
FIGS. 3–6 are views of the present invention showing the drop cloth being unfolded from the inside of the vest/jacket.

FIGS. 3–6 show the steps taken to unfold the drop cloth 10 in order to use it. The first step is shown in FIG. 3, where the drop cloth is unfolder, about a fold line 17, in a vertical direction from the position shown in FIG. 2. This will position the drop cloth into two side-by-side portions 15, 16 which are folded and unfolded along a fold line 17. The VELCRO hook and loop fasteners 11, 12, 13, 14 which hold the drop cloth in the folder position, shown in FIG. 2, are shown in FIG. 3. Obviously other fastening means can be substituted for the The VELCRO hook and loop fasteners if desired.

Figure 4:
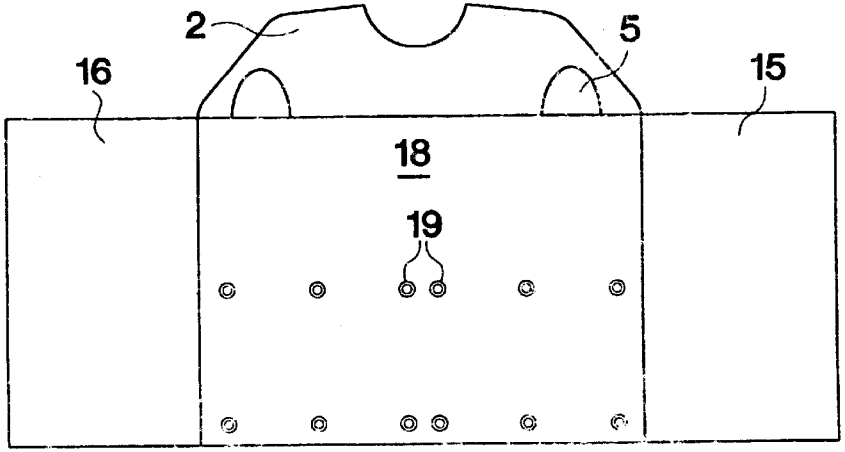

The next step is to unfold the drop cloth in a horizontal direction so the two portions 15, 16 are outside the area of the vest/jacket 2 as shown in FIG. 4. In this figure the snaps 19, which cooperate with complimentary snaps 20, shown in FIG. 6, and which hold the drop cloth to the vest/jacket are shown.

Figure 5:
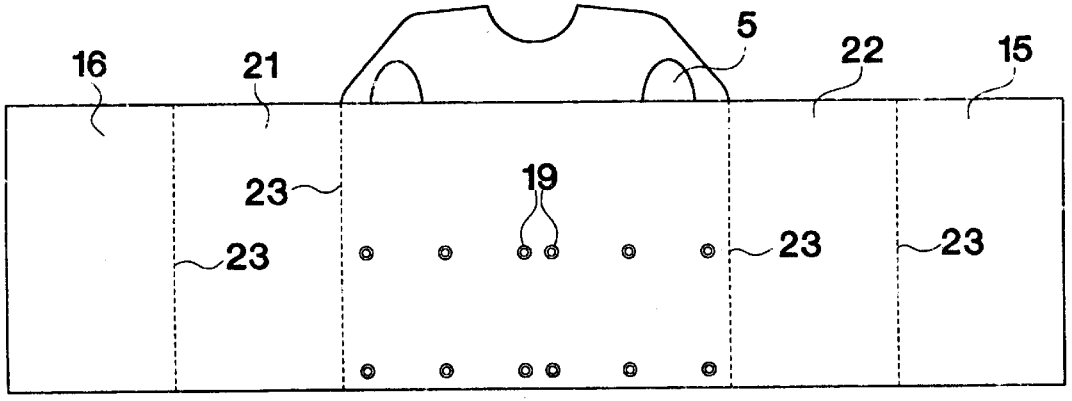

The next unfolding step is shown in FIG. 5, in which the portions 15, 16 are again unfolded in a horizontal direction to expose portions 21, 22. The dotted lines 23, shown in FIG. 5, are fold lines which are double seamed to allow the cloth to be folded and unfolded perfectly each time.

Figure 6:
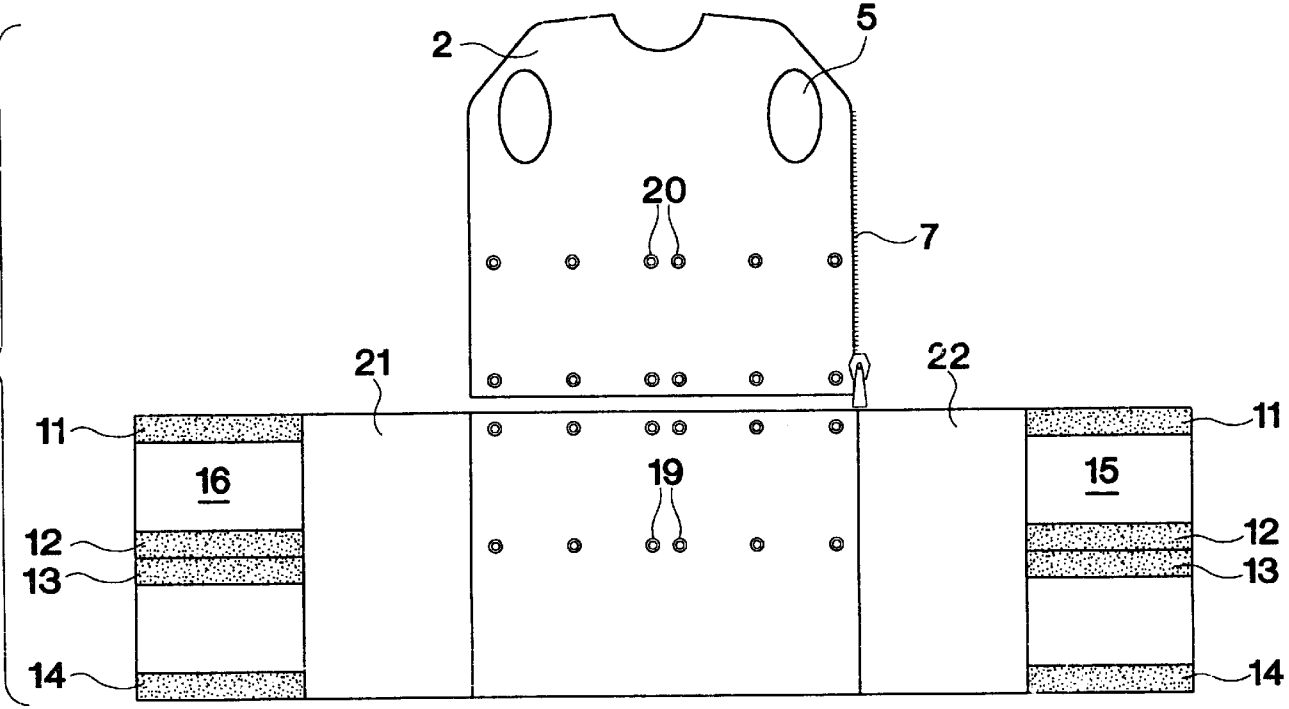

The final step is shown in FIG. 6, which shows the drop cloth after it has been unsnapped from the vest/jacket and positioned in a vertical downward direction from the vest/jacket. The drop cloth is now ready to be used by a painter. In order to place the drop cloth back in the vest/jacket, the above steps would be performed in the reverse order.

Although the Painter's Pal and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An article of clothing, in combination with a drop cloth adapted to be detached from said article of clothing and used to protect horizontal surfaces form accidentally dropped paint, comprising:

an elongated piece of material having a top, bottom, a back panel and two front panels, said back panel and said two front panels having an inside and an outside surface, means for holding said front panels in a closed position, a folded drop cloth detachably secured to said inside surface of said back panel adjacent said bottom.

2. The article of clothing as claimed in claim 1, wherein said article of clothing is a vest with detachable sleeves.

3. The article of clothing as claimed in claim 1, wherein said outside surface of said front panels have a plurality of pockets.

4. The article of clothing as claimed in claim 1, wherein loop means for holding tools are provided on said article of clothing.

5. The article of clothing as claimed in claim 1, wherein said drop cloth has at least a pair of fastening means for holding said drop cloth in a folded position.

6. The article of clothing as claimed in claim 1, wherein said drop cloth has a plurality of holding means which cooperate with complimentary holdings on said inside surface of said back panel for detachably securing said drop cloth to said inside surface of said back panel.

7. A method of using the article of clothing as claimed in claim 1, wherein said method comprises:

removing said article of clothing from a body of a user and placing it on a horizontal surface with said inside surface of said back panel facing up, unfolding said drop cloth in a first vertical direction, unfolding said drop cloth in a horizontal direction, unfolding said drop cloth a second time in a horizontal direction, detaching said drop cloth from said article of clothing and moving said drop cloth in a second vertical direction which is opposite from said first vertical direction.

* * * * *